United States Patent [19]

Habeeb et al.

[11] Patent Number: 5,076,945

[45] Date of Patent: Dec. 31, 1991

[54] LUBRICATING OIL CONTAINING ASHLESS NON-PHOSPHORUS ADDITIVE

[75] Inventors: Jacob J. Habeeb; Morton Beltzer, both of Westfield; Nicholas Feldman, Woodbridge, all of N.J.

[73] Assignee: Exxon Research and Engineering Company, Florham Park, N.J.

[21] Appl. No.: 582,316

[22] Filed: Sep. 14, 1990

[51] Int. Cl.[5] ..... C10M 133/16

[52] U.S. Cl. ..... 252/47.5; 252/47; 252/57

[58] Field of Search ..... 252/47, 475, 57

[56] References Cited

U.S. PATENT DOCUMENTS 4,877,541 10/1989 Wisotsky et al. ..... 252/47.5

*Primary Examiner*—Prince Willis, Jr.
*Assistant Examiner*—Maria Nuzzolillo
*Attorney, Agent, or Firm*—Roy J. Ott

[57] ABSTRACT

A lubricating oil composition having improved antiwear, antioxidation, and extreme pressure performance comprises a lubricating oil and a long chain hydrocarbyl amine, such as tallow amine, salt or amide of a derivative of benzoic acid or dithiobenzoic acid such as 4-hydroxy-3, 5-di-tert-butyldithiobenzoic acid.

9 Claims, No Drawings

LUBRICATING OIL CONTAINING ASHLESS NON-PHOSPHORUS ADDITIVE

BACKGROUND OF THE INVENTION

1. Field of the Invention

This invention relates to an ashless nonphosphorus lubricating oil additive which imparts improved antiwear, antioxidation, and extreme pressure performance. More particularly, the invention relates to a lubricating oil composition containing an amine salt and/or amide of a derivative of thiobenzoic acid.

2. Description of the Prior Art

It is well known that engine lubricating oils require the presence of additives to protect the engine from wear. Phosphorus-containing additives have been used for this purpose in lubricants for many years. Metal organo phosphorodithioates and, in particular zinc dialkyldithiophosphate (ZDDP), have been used in crank case lubricants for many years as anti-oxidants and anti-wear/load carrying additives. Unfortunately, the presence of phosphorus and/or metals in crank case lubricants has been implicated either in the deactivation of emission control catalysts used in automotive exhaust systems or in deposit and sludge formation. There exists, therefore, a need for an ashless, nonphosphorus containing lubricating oil for use in gasoline and diesel engines.

The use of amine salts of certain benzoic acid derivatives as extreme pressure EP agents for water-based metal cutting fluids has been described in the literature. For example, Japanese Pat. No. 55023132 describes a water-based metal cutting fluid containing an EP agent comprised of an alkali metal salt, an ammonium salt, an amine salt, or an ester of a halogenated benzoic acid derivative such as hydroxy benzoic acid, alkoxy benzoic acid, alkyl benzoic acid etc. The EP agent is claimed to have excellent lubricating property, rusting resistance, and EP properties as compared with conventional nitrites typically used for water-based metal cutting fluids.

The use of substituted benzoic acids as EP agents in water-based fluids is also described in U.S. Pat. No. 4,569,776. For example, this patent discloses a water-based hydraulic fluid composition comprising substituted aromatic compounds like benzoic acids, aromatic sulfonic acids, phenyl alkyl acids and substituted benzenes. Examples of these compounds include mono-, di-, and triaminobenzoic acids; alkylsubstituted ($C_1$ to $C_{12}$ atoms) mono-, di-, and triaminobenzoic acids and mono-, di-, and trialkoxy ($C_1$ to $C_{12}$ atoms) benzoic acids.

U.S. Pat. No. 4,434,066 discloses a water based hydraulic fluid containing a combination of a hydroxyl-substituted aromatic acid component and a nitroaromatic compound component. Suitable acidic materials include saturated and unsaturated aliphatic carboxylic and polycarboxylic acids having at least six carbon atoms, aromatic carboxylic acids and alkali metal or organic amine salts of said aliphatic and aromatic acids.

U.S. Pat. No. 4,012,331 discloses a lubricating oil composition comprising a sulfur compound prepared by reacting a trithiolan compound with a thoil compound in the presence of a base where the thio compound comprises thiophenol, thiosalicylic acid, thioacetic acid, thioglycolic acid, thiobenzoic acid, etc., including an amine or alkali metal salt thereof.

SUMMARY OF THE INVENTION

This invention concerns a lubricating oil composition comprising a lubricating oil base stock and about 0.01 to 5, preferably 0.5 to 2.0, weight percent (based on the total weight of the lubricating oil composition) of an oil-soluble hydrocarbyl substituted amine salt and/or amide, preferably an amine salt, of a compound having the formula:

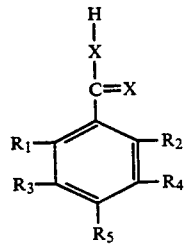

wherein X is oxygen or sulfur, preferably sulfur, and $R_1$, $R_2$, $R_3$, $R_4$ and $R_5$ are selected from hydrogen; a hydrocarbyl group containing 1 to 24 carbon atoms, preferably an alkyl group containing 1 to 18 carbon atoms; a hydroxy group, i.e., —OH; and an oxygen-containing hydrocarbyl group containing 1 to 24 carbon atoms and at least one of the radicals $R_1$, $R_2$, $R_3$, $R_4$ or $R_5$ is a hydrocarbyl, preferably an alkyl group, containing 1 - 18 carbon atoms, more preferably 1–6 carbon atoms. The radicals $R_3$ and $R_4$ are most preferably t-butyl groups.

In another embodiment, this invention concerns a method for reducing the wear of an internal combustion engine by lubricating the engine with the lubricating oil composition of the invention.

DETAILED DESCRIPTION OF THE INVENTION

In general, the lubricating oil composition of the invention will comprise a major amount of a lubricating oil basestock and a minor amount of an amine salt and/or amide of a derivative of benzoic acid or dithiobenzoic acid. If desired, other lubricating oil additives may be present in the oil as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl axelate, diisodecyl azelate, dioctyl, phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_2$ monocarboxylic acids and polyols and polyol ethers such as neopentyl glycol, trimethylolpropane, pentaerythritol, dipentaerylthri tol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating oil will contain a hydrocarbyl substituted amine salt and/or amide, preferably an amine salt, of an oil soluble compound having the formula:

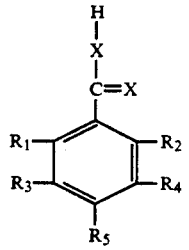

wherein X is oxygen or sulfur, preferably sulfur, and $R_1$, $R_2$, $R_3$, $R_4$ and $R_5$ are selected from hydrogen; a hydrocarbyl group containing 1 to 24 carbon atoms, preferably an alkyl group containing 1 to 18 carbon atoms; a hydroxy group, i.e., —OH; and an oxygen-containing hydrocarbyl group containing 1 to 18 carbon atoms and at least one of the radicals $R_1$, $R_2$, $R_3$, $R_4$ or $R_5$ is a hydrocarbyl, preferably an alkyl group, containing 1–18 carbon atoms, most preferably 1–6 carbon atoms.

Specific examples of the benzoic or dithiobenzoic acid derivatives include 4-hydroxy 3,5 ditertiary butyl dithiobenzoic acid; 4-hydroxy 3,5 ditertiary butyl benzoic acid; 3,5 dimethyl dithiobenzoic acid; 4-hydroxy 3,5 dimethyl dithiobenzoic acid and the like.

The oil soluble additive is formed in a conventional manner by mixing substantially equimolar amounts of the benzoic acid derivative and a hydro carbyl substituted amine at temperatures generally in the range of 20° C.–100° C.

The hydrocarbyl groups of the amine include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g. $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil soluble. The number of carbon atoms necessary to confer oil solubility will vary with the degree of polarity of the compound. The compound will preferably also have at least one straight chain alkyl segment extending from the compound containing 8 to 40, e.g. 12 to 30 carbon atoms.

The amines may be primary, secondary, tertiary or quarternary, but preferably are secondary. If amides are to be made, then primary or secondary amines will be used.

Examples of primary amines include n-dodecyl amine, n-tridecyl amine, $C_{13}$ Oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methylbehenyl amine, ditallow amine etc. Examples of tertiary amines include coco-diethyl amine, cyclohexyl-diethyl amine, coco-dimethyl amine, tri-n-octyl amine, dimethyldodecyl amine, methyl-ethyl-coco amine, methyl-cetyl stearyl amine, etc.

Amine mixtures may also be used and many amines derived from natural materials are mixtures. The preferred amines include the long straight chain alkyl amines containing 8–40, preferably 12 to 24, carbon atoms. Naturally occurring amines, which are generally mixtures, are preferred. Examples include coco amines derived from coconut oil which is a mixture of primary amines with straight chain alkyl groups ranging from $C_8$ to $C_8$. Another example is di tallow amine, derived from hydrogenated tallow acids, which amine is a mixture of $C_{14}$ to $C_{18}$ straight chain alkyl groups. Di tallow amine is particularly preferred.

Oil soluble, as used herein, means that the additive is soluble in the lubricating oil at ambient temperatures, e.g., at least to the extent of about 5 wt.% additive in the lubricating oil at 25° C.

The invention will be further understood by reference to the following Examples which include preferred embodiment of the invention.

EXAMPLE 1

Preparation of Ashless, Non-phosphorous Additive

The ditalow amine salt of 4-hydroxy -3, 5-di-tert-butyldithiobenzoic acid was prepared as follows: 2,6-di-tert-butyl phenol (20.6 g) was dissolved in dimethylsulphoxide (60 $cm^3$). To this well stirred solution under nitrogen was added KOH (5.6 g) dissolved in the minimum amount of water. After the addition was completed, $CS_2$ (7.6 g) was run in maintaining the temperature between 20–25° C. The mixture was maintained at this temperature for one hour, at 60° C. for two hours and then cooled and poured into water (250 $cm^3$). After acidification (10% HCl), extraction into diethylether and drying over $Na_2SO_4$ the product was isolated by roto-evaporation (calculated for $C_{15}H_{22}OS_2$, C=63.83 wt. % and H=7.80 wt. %; found C=63.65 wt. % and H=7.86 wt. %).

The final product was then prepared by slowly adding 27.06 grams of the dithiobenzoic acid with stirring at 90° C. to 50.0 grams of dihydrogenated tallow amine. The tallow amine is sold under the tradename Armeen 2HT.

EXAMPLE 2

Four Ball Wear Tests

Four Ball Wear tests were performed to determine the wear reducing effectiveness of the ditallow dithiobenzoate prepared in Example 1.

The Four Ball test used is described in detail in ASTM method D-2266, the disclosure of which is incorporated herein by reference. In this test, three balls are fixed in a lubricating cup and an upper rotating ball is pressed against the lower three balls. The test balls utilized were made of AISI 52100 steel with a hardness of 65 1 Rockwell C (840 Vickers) and a centerline roughness of 25 mm. Prior to the tests, the test cup, steel balls, and all holders were degreased with ,1,1,1 trichlorethane. The steel balls subsequently were washed with a laboratory detergent to remove any solvent residue, rinsed with water, and dried under nitrogen.

The base lubricant utilized in all of these tests was 150 Neutral (S-150N) — a solvent extracted, dewaxed hydrofined neutral basestock having a viscosity of 32 centistokes (150 SSU) at 40° C. The Four Ball wear tests were performed at 100° C., 60 kg load, and 1200 rpm for 45 minutes duration.

After each test, the balls were degreased and the Wear Scar Diameter (WSD) on the lower balls measured using an optical microscope. Using the WSD's, the wear volume was calculated from standard equations (see Wear Control Handbook, edited by M. B. Peterson and W. 0. Winer, p. 451, American Society of Mechanical Engineers [1980]). The results for these tests are shown below in Table 1. It is seen that the additive of this invention significantly reduces wear.

TABLE 1

| Concentration of Ditallow Dithiobenzoate of Example 1 in S-150N, Wt. % | Four Ball WSD, mm | Wear Volume $mm^3 \times 104$ |
|---|---|---|
| 0 | 1.5 | 391 |
| 0.25 | 0.95 | 63 |
| 0.50 | 0.77 | 27 |
| 1.0 | 0.76 | 25 |

EXAMPLE 3

Differential Scanning Calorimetry (DSC) Tests

The DSC heats a test sample in air at a programmed rate and measures its temperature rise compared to an inert reference. If the sample undergoes an exothermic or endothermic reaction or phase change, the event and magnitude of the heat effects are monitored and recorded. The temperature at which the exothermic reaction due to oxidation by atmospheric oxygen starts (the oxidation onset temperature) is used as a first-pass parameter for measuring the oxidation stability of an oil. A high temperature represents a more stable oil.

The rate of temperature increase selected was 5° C./minute in the temperature rang 50° C. to 300° C.

The DSC technique is described by R. L. Blaine "Thermal Analytical characterization of Oils and Lubricants" American Laboratory, Vol. 6, PP 460–463 (January, 1974) and F. Noel and G. E. Cranton in "Application of Thermal Analysis to Petroleum Research", American Laboratory, Vol. 11, PP 27–50 (June, 1979) which are incorporated herein by reference.

The antioxidant properties of the additive of Example 1 are shown in the DSC results in Table 2.

TABLE 2

| Concentration of Ditallow Amine Dithiobenzoate of Example 1 in S-150N, wt % | DSC Oxidation Onset, C.° |
|---|---|
| 0 | 210 |
| 0.25 | 238 |
| 0.50 | 234 |
| 1.0 | 237 |

EXAMPLE 4

Engine Wear Tests

This example demonstrates the antiwear properties of the additive of this invention compared to the well-known antiwear additive zinc dialkyldithiophosphate (ZDDP).

The wear properties were evaluated in valve train wear tests utilizing a Ford 2.3 liter engine with the pistons and connecting rods removed. The engine was driven with an 11.2 KW (15 horsepower) DC drive motor through a 1.2 timing belt drive. The engine was equipped with Oldsmobile valve springs (146.5–148.3

KG) to increase the load between the cam lobes and the followers. Both oil and coolant circulation were accomplished by use of the engine mounted pumps. All test runs were made at 90° C. oil temperature, 90' C. coolant temperature, approximately 331 kPa oil pressure and an engine speed of 1,000 plus or minus 6 rpm.

During operation, wear is generated on the lobes of the cam shaft and followers due to the sliding contact. As in the sequence V-D test described in ASTM Test No. STP 315H-Part 3, the disclosure of which is incorporated herein by reference, wear is defined as the reduction of the head-to-toe measurement at the point of maximum lift on the cam shaft. A pre-measured cam shaft is measured at various time intervals during the test to establish the reduction in the head-to-tow distance, i.e. the degree of wear. The tests were conducted with a commercially available lubricating oil from which the anti-wear additive had been removed and which were modified somewhat to simulate actual used oil conditions.

The ditallow amine salt of 4-hydroxy-3, 5-di-tert-butyldithiobenzoic acid prepared in Example 1 and ZDDP were blended in the test oil and evaluated in the valve train test described above. The results at engine operating times of 20, 40, and 60 hours are shown in Table 3. It is seen that the additive of the invention resulted in less wear than ZDDP.

TABLE 3

| Additive Concentration wt % | | Average Cam lobe Wear, Micron (μm) | | |
|---|---|---|---|---|
| ZDDP | Additive of Example 1 | 20 Hr | 40 Hr | 60 Hr |
| 0.6 | — | 34 | 51 | — |
| — | 0.6 | 7 | 15 | 16 |
| 1.0 | — | 17 | 18 | 19 |
| 0.6 | 1.0 | 8 | 17 | 17 |

What is claimed is:

1. A lubricating oil composition comprising a lubricating oil basestock and about 0.1–5 wt. % of an oil-soluble additive comprises of a hydrocarbyl substituted amine salt of a compound having the formula:

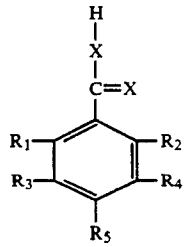

wherein X is oxygen or sulfur, and $R_1$, $R_2$, $R_3$, $R_4$ and $R_5$ are selected from hydrogen; a hydrocarbyl group containing 1 to 24 carbon atoms; a hydroxy group, and an oxygen-containing hydrocarbyl group containing 1 to 24 carbon atoms and at least one of the radicals $R_1$, $R_2$, $R_3$, $R_4$ and $R_5$ is a hydrocarbyl group containing 1–24 carbon atoms.

2. The lubricating oil composition of claim 1 wherein the hydrocarbyl substituted amine used in the preparation of the oil-soluble additive comprises at least one straight chain alkyl group containing 8 to 40 carbon atoms.

3. The lubricating oil composition of claim 2 wherein at least one of the radicals $R_1$, $R_2$, $R_3$, $R_4$ or $R_5$ is a hydrocarbyl radical containing 1–18 carbon atoms.

4. The lubricating oil composition of claim 3 wherein X represents sulfur.

5. The lubricating oil composition of claim 4 wherein at least one of the radicals $R_1$, $R_2$, $R_3$, $R_4$ or $R_5$ is an alkyl group containing 1–6 carbon atoms.

6. The lubricating oil composition of claim 5 wherein the hydrocarbyl substituted amine comprises at least one straight chain alkyl group containing 12 to 24 carbon atoms.

7. The lubricating oil composition of claim 6 wherein the hydrocarbyl substituted amine is a tallow amine.

8. The lubricating oil composition of claim 7 wherein the oil soluble additive is a ditallow amine salt of 4-hydroxy-3, 5-di-tert-butyldithiobenzoic acid.

9. The lubricating oil composition of claim 1 wherein said composition is ashless and nonphosphorus containing.

* * * * *